US007827958B2

(12) United States Patent
Dietrich et al.

(10) Patent No.: US 7,827,958 B2
(45) Date of Patent: Nov. 9, 2010

(54) GAS EXCHANGE VALVE ACTUATING DEVICE

(75) Inventors: Markus Dietrich, Oberrot (DE); Stefan Rudert, Stuttgart (DE)

(73) Assignee: Daimler AG, Stuttgart (DE)

( * ) Notice: Subject to any disclaimer, the term of this patent is extended or adjusted under 35 U.S.C. 154(b) by 151 days.

(21) Appl. No.: 12/218,622

(22) Filed: Jul. 16, 2008

(65) Prior Publication Data

US 2009/0071436 A1 Mar. 19, 2009

Related U.S. Application Data

(63) Continuation-in-part of application No. PCT/EP2007/000281, filed on Jan. 13, 2007.

(30) Foreign Application Priority Data

Jan. 17, 2006 (DE) ..... 10 2006 002 145

(51) Int. Cl.
*F02D 13/04* (2006.01)

(52) U.S. Cl. ..... 123/321

(58) Field of Classification Search ..... 123/320, 123/321, 322

See application file for complete search history.

(56) References Cited

U.S. PATENT DOCUMENTS

| | | | | |
|---|---|---|---|---|
| 4,711,210 | A | 12/1987 | Reichenbach | |
| 5,000,145 | A * | 3/1991 | Quenneville | 123/321 |
| 5,036,810 | A | 8/1991 | Meneely | |
| 6,386,160 | B1 * | 5/2002 | Meneely et al. | 123/90.16 |
| 6,647,954 | B2 * | 11/2003 | Yang et al. | 123/321 |
| 6,883,492 | B2 * | 4/2005 | Vanderpoel et al. | 123/321 |
| 7,152,576 | B2 * | 12/2006 | Vanderpoel et al. | 123/321 |
| 2002/0017273 | A1 * | 2/2002 | Dellora et al. | 123/321 |
| 2003/0188703 | A1 | 10/2003 | Vanderpoel | |
| 2003/0221663 | A1 * | 12/2003 | Vanderpoel et al. | 123/321 |
| 2005/0145216 | A1 * | 7/2005 | Yang et al. | 123/321 |
| 2005/0252466 | A1 * | 11/2005 | Albat et al. | 123/321 |
| 2005/0252484 | A1 * | 11/2005 | Vanderpoel et al. | 123/321 |
| 2005/0274341 | A1 | 12/2005 | Usko et al. | |

FOREIGN PATENT DOCUMENTS

| | | |
|---|---|---|
| EP | 0 818 612 | 3/2002 |
| WO | WO 96/39574 | 12/1996 |

* cited by examiner

*Primary Examiner*—Stephen K Cronin
*Assistant Examiner*—Arnold Castro
(74) *Attorney, Agent, or Firm*—Klaus J. Bach

(57) ABSTRACT

In a gas exchange valve actuating device having a lever for transmitting a drive movement to at least one gas exchange valve of an engine braking control unit of an internal combustion engine, the internal combustion engine includes a compact braking control unit which is coupled to the valve operating lever for controlling actuation of the gas exchange valves in a braking mode of engine operation.

9 Claims, 4 Drawing Sheets

GAS EXCHANGE VALVE ACTUATING DEVICE

This is a Continuation-In-Part Application of pending international patent application PCT/EP2007/000281 filed Jan. 13, 2007 and claiming the priority of German patent application 10 2006 002 145.2 filed Jan. 17, 2006.

BACKGROUND OF THE INVENTION

The invention relates to a gas exchange valve actuating device of an internal combustion engine including an actuating lever for transmitting the drive movement of a camshaft to the gas exchange valves of the engine.

A generic gas exchange valve actuating device having a lever for transmitting a drive movement to gas exchange valves is known, for example, from EP 0 818 612 B1. The gas exchange valve actuating device further includes an internal combustion engine braking arrangement. The internal combustion engine braking arrangement wherein at least one of the gas exchange valves is coupled with a valve operating control mechanism for opening an exhaust valve at a time different from the normal timing.

It is the object of the invention to provide a gas exchange valve actuating device coupled in terms of drive with an additional valve operating control mechanism, which, for engine braking operation, provides selectively for valve opening times which are different from the normal timing and which is of an especially compact design.

SUMMARY OF THE INVENTION

In a gas exchange valve actuating device having a lever for transmitting a drive movement to at least one gas exchange valve of an engine braking control unit of an internal combustion engine, the internal combustion engine includes a compact braking control unit which is coupled to the valve operating lever for controlling actuation of the gas exchange valves in a braking mode of engine operation.

"Coupled in terms of drive" should be understood here to mean, in particular, that in at least one braking mode of the internal combustion engine braking unit the lever is used as a force-transmitting means to actuate at least one gas exchange valve. With the arrangement according to the invention, existing components can advantageously be used, so that additional components, installation space, weight and assembly complexity can be saved, to be precise especially if the lever is provided for actuating at least two gas exchange valves. In addition, if the lever is provided for actuating at least two gas exchange valves, an advantageous equal lift and equal control timing of the corresponding gas exchange valves can be achieved. The lever may comprise by various levers which appear appropriate to a person skilled in the art and which are pivoted with or without a spatially fixed bearing axis, such as, in particular, rocker arms or follower arms. In this context "provided" should be understood to mean, in particular, specially equipped and/or designed.

In a further configuration it is proposed that the internal combustion engine braking unit includes a hydraulic unit for transmitting a drive movement to the gas exchange valve, whereby large forces can be transmitted in a constructionally simple manner which is especially flexible and space-saving. In principle, however, other force-transmitting units which appear appropriate to the person skilled in the art are also possible, such as, in particular, purely mechanical, electromechanical and/or electromagnetic force-transmitting units, etc.

Furthermore, additional components and assembly complexity and costs can be saved if the internal combustion engine braking unit includes a one-piece housing unit which has at least one bearing for a slave piston and at least one bearing for a master piston of a hydraulic unit and, in particular, if the housing unit has, at least additionally, at least one bearing for a valve means. Alternatively, the hydraulic unit of the internal combustion engine braking unit might be partly or even wholly integrated in a camshaft housing and/or a cylinder head.

If the internal combustion engine braking unit includes a hydraulic lift limiting unit, a desired lift of the gas exchange valve for a braking mode can be advantageously implemented in an especially flexible and precisely adjustable manner.

In a further configuration of the invention it is proposed that the internal combustion engine braking unit has a cam follower including a roll body, whereby especially low friction operation can be achieved, in particular during a braking mode. Alternatively, however, it is also possible to provide a cam follower with a sliding element for coupling to a cam.

Furthermore, friction and associated losses can be reduced if the internal combustion engine braking unit is uncoupled from the lever in at least one operating mode and/or the internal combustion engine braking unit is uncoupled from a drive means, such as, in particular, a cam, in at least one operating mode. "Uncoupled" should be understood here to mean, in particular, that a part of the internal combustion engine unit for driving the lever, which part is moved in the at least one braking mode, or a part of the internal combustion engine unit which is moved by a drive means in the at least one operating mode differing from the braking mode, is uncoupled from the movement of the lever or from the movement of the drive means.

If the internal combustion engine braking unit has a brake cam with at least two elevations, the freedom for configuring a braking mode can be increased and, in particular, a braking operation can be optimized.

In a further configuration of the invention it is proposed that the internal combustion engine braking unit has at least one control and/or regulating means which is provided for actuating gas exchange valves associated with at least two different internal combustion engine cylinders, whereby additional components, installation space, assembly complexity and costs can again be saved.

The invention will become more readily apparent from the following description thereof on the basis of the accompanying drawings. In the drawings, an exemplary embodiment of the invention is represented.

DESCRIPTION OF A PARTICULAR EMBODIMENT OF THE INVENTION

Figure 1:
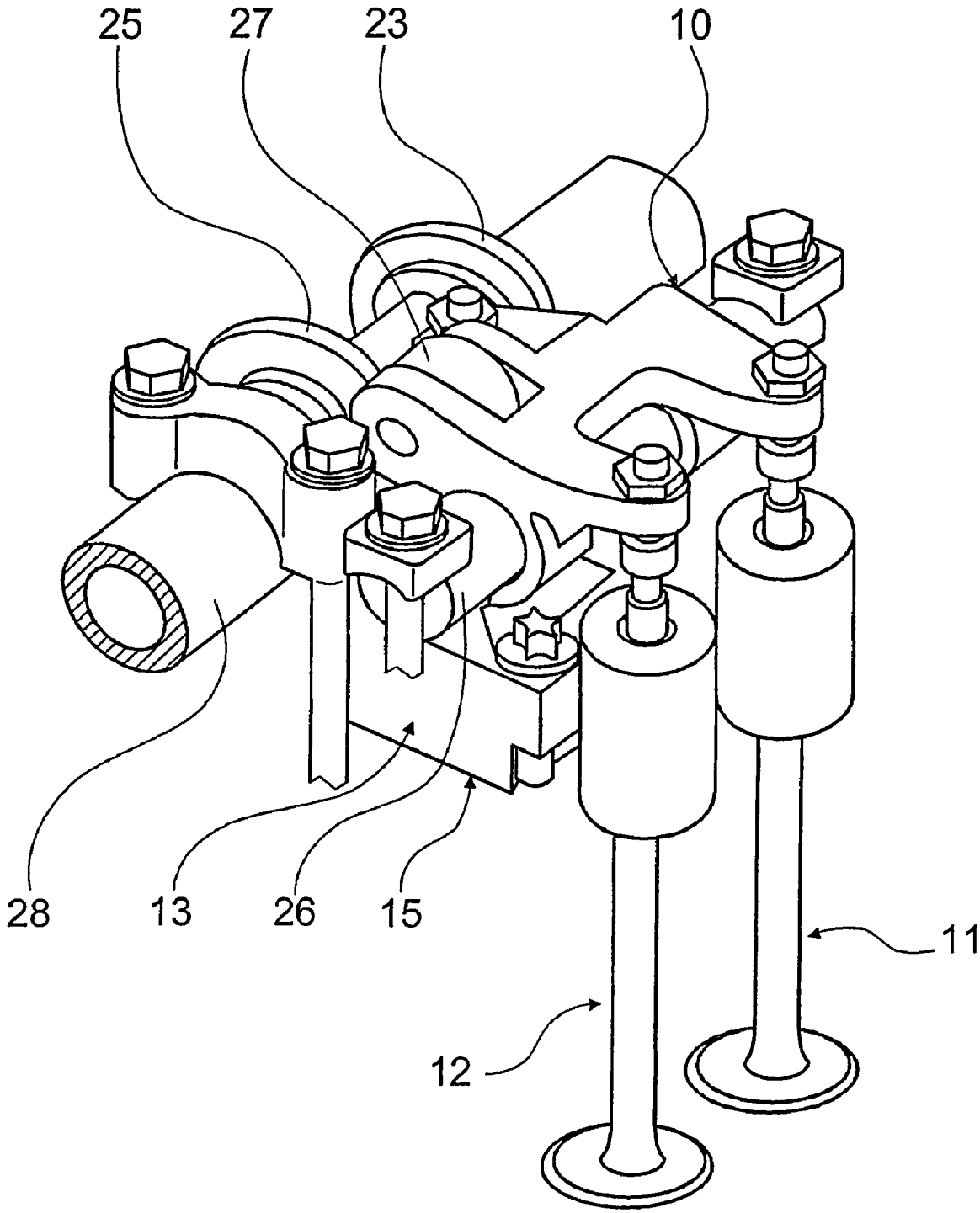
FIG. 1 shows in a perspective top view a portion of an internal combustion engine with a gas exchange valve actuating device inventive according to the invention.
Figure 2:
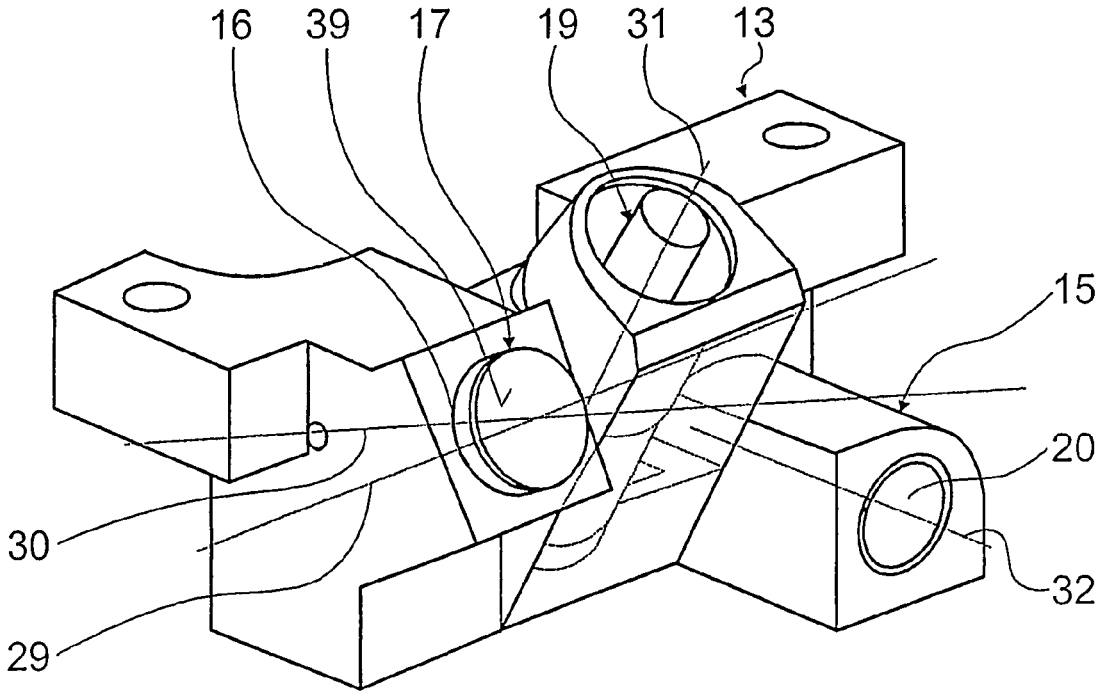
FIG. 2 shows in a perspective top view a housing unit of an internal combustion engine braking unit of the gas exchange valve actuating device shown in FIG. 1 with further operating units mounted therein.

FIG. 1 shows, in a perspective top view, a portion of an internal combustion engine, that is, an inventive gas exchange valve actuating device of the engine. The gas exchange valve actuating device includes a forked rocker arm 10 for transmitting a drive movement from an exhaust cam 25 arranged on an exhaust camshaft 28 to two gas exchange valves 11, 12 which form exhaust valves. The rocker arm 10 is mounted pivotably on a bearing pin 26 and is coupled to the exhaust cam 25 via a cam follower formed by a roll body 27.

The gas exchange valve actuating unit further includes an internal combustion engine braking unit 13 comprising a hydraulic unit, which internal combustion engine braking unit 13, in a braking mode (FIGS. 2 to 6), is coupled in terms of drive to the rocker arm 10. The internal combustion engine braking unit 13 has a one-piece housing 15 which has a support structure 16 for a slave piston 17, a support structure 18 for a master piston 19 and a support structure 20 for a valve means 21 formed by a control valve.

Figure 3:
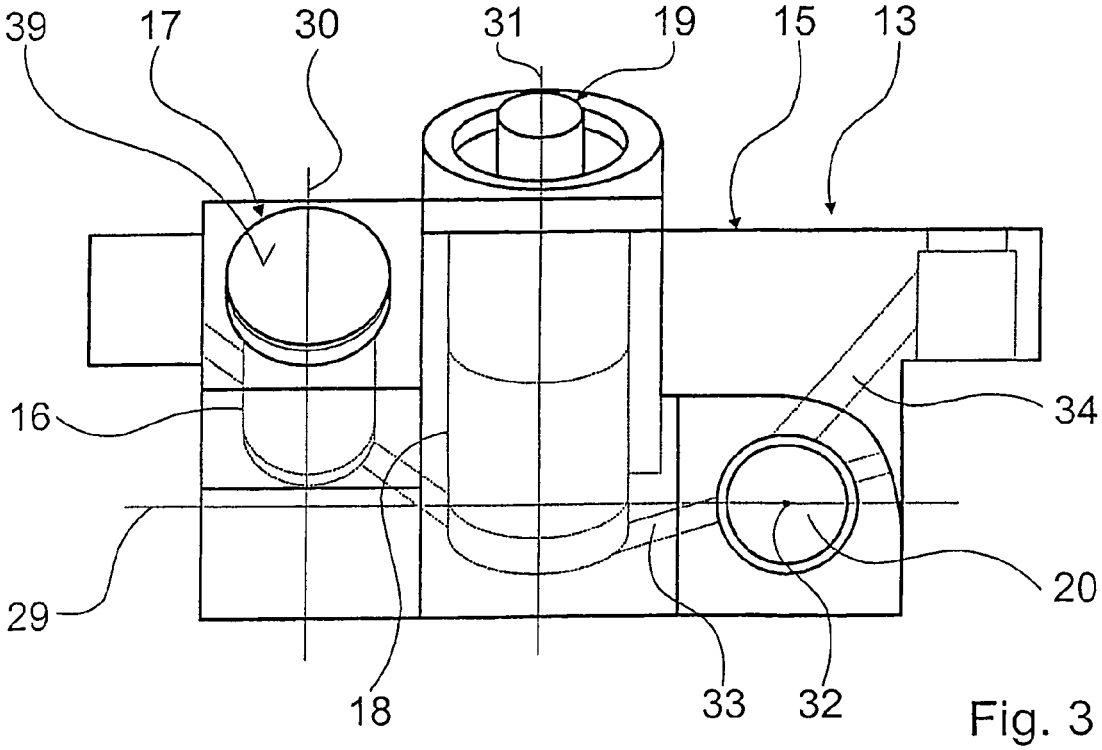
FIG. 3 shows the housing unit of FIG. 2 in a front view.
Figure 4:
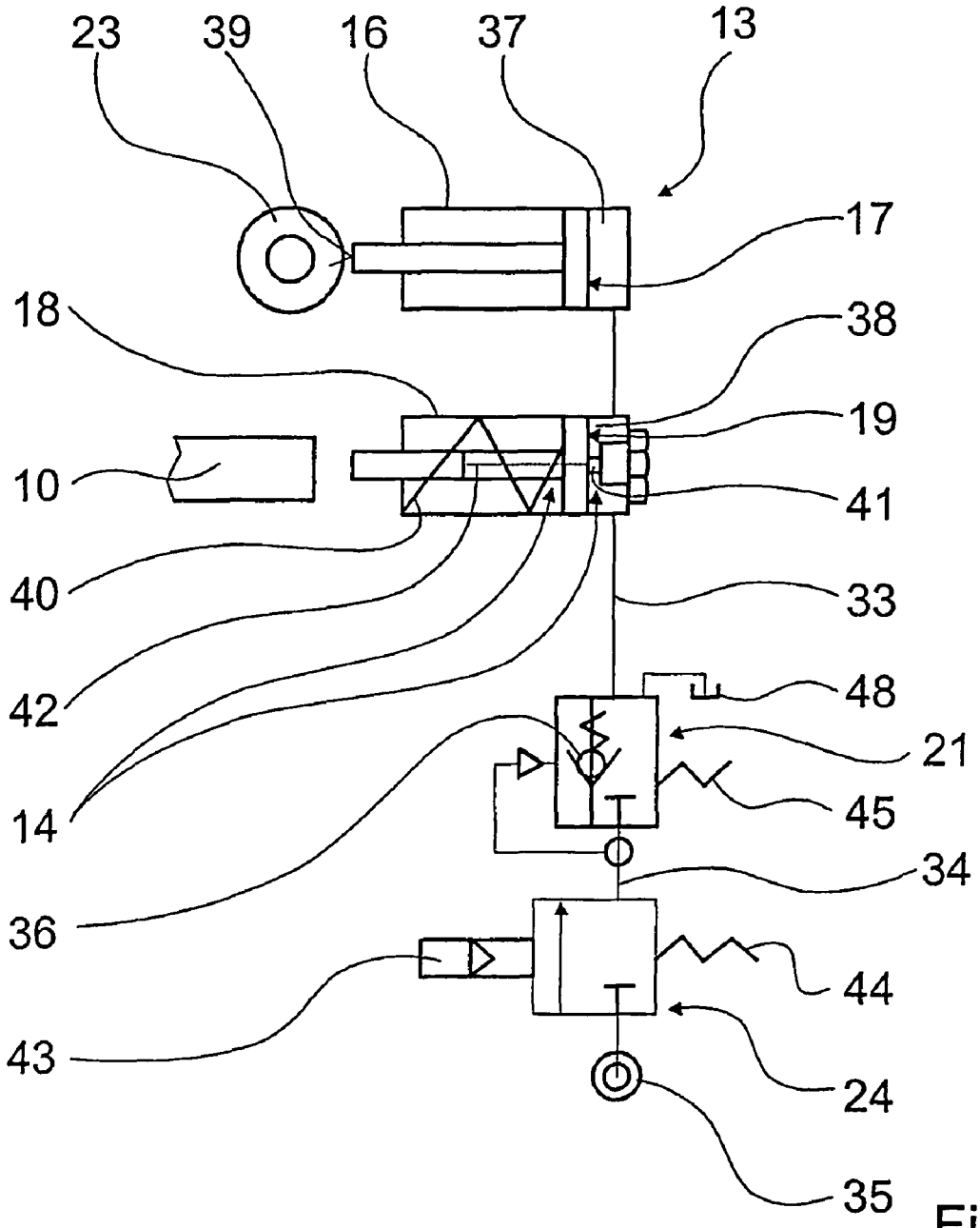
FIG. 4 shows schematically a hydraulic diagram of the gas exchange valve actuating device of FIG. 1.

The slave piston 17 is guided movably along an axis of movement 30, the master piston 19 along an axis of movement 31 and valve means 21 along an axis of movement 32, the axes of movement 30, 31, 32 each being aligned perpendicularly with respect to an axis 29 of the housing unit 15 and obliquely with respect to one another. The pistons 17, 19 and the valve means 21 are connected to one another via hydraulic passages 33 of the housing unit 15. In addition, the housing unit 15 has a supply passage 34 via which, and via a central control means 24 formed by a solenoid valve, the valve means 21 and the pistons 17, 19 can be coupled to an internal combustion engine oil circuit 35 and can be pressurized by internal combustion engine lubricating oil (FIGS. 3 and 4). The control means 24 is provided for actuating a plurality of gas exchange valves 11, 12 associated with the various internal combustion engine cylinders.

Figure 5:
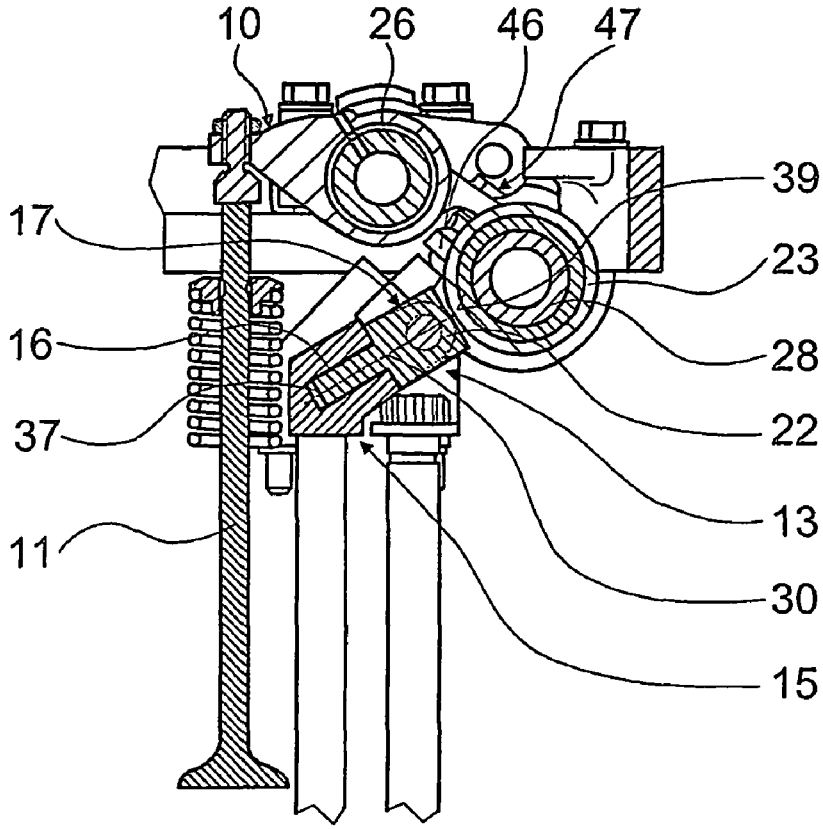
FIG. 5 is a cross sectional view of the gas exchange valve actuating device taken in the region of a slave piston of the internal combustion engine braking unit.
Figure 6:
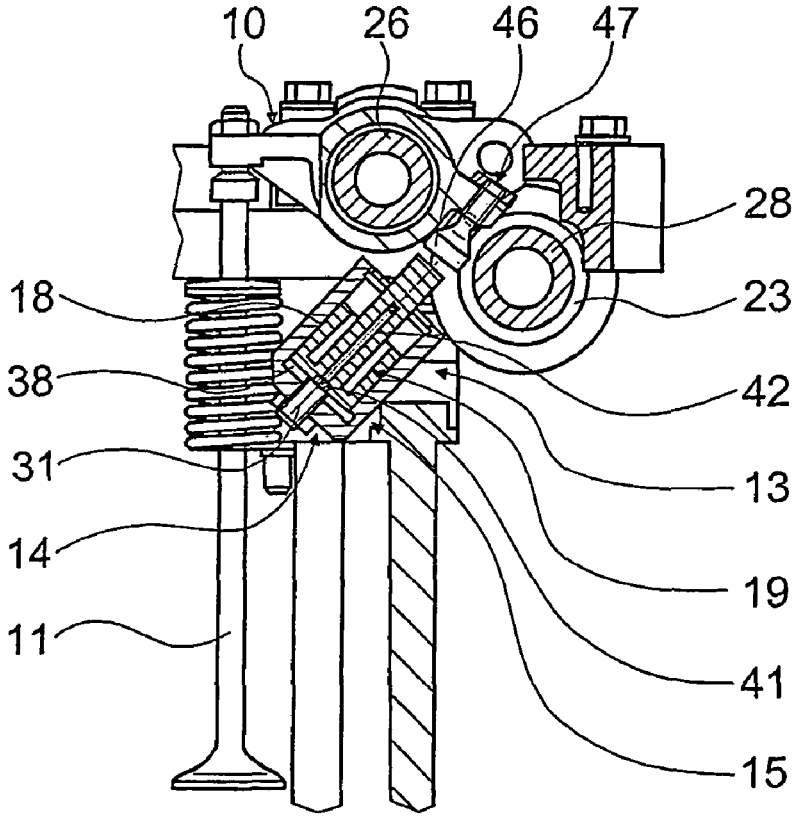
FIG. 6 is a cross sectional view of the gas exchange valve actuating device taken in the region of a master piston of the internal combustion engine braking unit.

With the braking mode deactivated, that is in a drive mode of the internal combustion engine, the slave piston 17 is at a distance from a brake cam 23 arranged on the camshaft and forming a drive means of the internal combustion engine braking unit 13, and the master piston 19 is arranged at a distance from the rocker arm 10, or the internal combustion engine braking unit 13 is uncoupled from the movement of the brake cam 23 and from the movement of the rocker arm 10 (FIGS. 4 to 6).

If the braking mode is activated, the control means 24 is switched by means of an electromagnet 43 against the force of a spring element 44 from its blocking position shown in FIG. 4 to its flow position. The valve means 21 is subjected to pressure and, as a result, switches from its blocking position shown in FIG. 4, against a spring force of a spring element 45, to its flow position, so that pressure chambers 37, 38 of the housing unit 15 are charged with internal combustion engine oil via a non-return valve 36 integrated in the valve means 21, and the slave piston 17 is loaded in the direction of the brake cam 23 and the master piston 19 in the direction of the rocker arm 10. As a result, the sliding surface 39 of the slave piston 17 bears against the brake cam 23, which has a plurality of elevations. Instead of a sliding surface 39, the internal combustion engine braking unit 13 might also be configured with a cam follower 22 including a roll body, as indicated in FIG. 5.

The master piston 19 is in part formed integrally with a hydraulic lift limiting unit 14 of the internal combustion engine braking unit 13 (FIGS. 4 and 6). The lift limiting unit 14 includes a return spring 40 which loads the master piston 19 in the direction away from the rocker arm 10 and presses an end face of the master piston 19 disposed remote from the rocker arm 10 against a closing means 41 which is arranged on the side facing away from the rocker arm 10 and which is spring-biased in the direction toward the rocker arm 10. The closing means 41 closes a passage 42 in the master piston 19.

As long as, in the braking mode, the slave piston 17 slides on a base circle of the brake cam 23, the master piston 19 is held by the return spring 40 in its position remote from the rocker arm 10.

If the slave piston 17 is deflected by one of the elevations of the brake cam 23 in the direction away from the brake cam 23, the master piston 19 is displaced in the direction of the rocker arm 10 and bears against a joint head 46 of an adjusting screw 47 fixed in the rocker arm 10 (FIG. 6). The internal combustion engine braking unit 13, or a braking clearance, can be adjusted via the adjusting screw 47. The rocker arm 10 is then moved via the master piston 19, and the gas exchange valves 11, 12 are opened. Shortly before a reference opening lift is reached in the braking mode, the closing means 41, which up to this time has followed the movement of the master piston 19, moves in the direction of the rocker arm 10 against a stop and the master piston 19 lifts slightly away from the closing means 41 in the direction of the rocker arm 10, so that internal combustion engine oil can flow out of the pressure chamber 38 via an annular gap forming between the closing means 41 and the master piston 19, and via the passage 42. For adjusting the reference opening lift, both the position of the stop of the closing means 41 and the spring force with which the closing means 41 is pressed against the master piston 19 are adjustable. Leakage oil and internal combustion engine oil flowing away via the passage 42 can flow in via the non-return valve 36, so that over a certain time a substantially constant opening lift is established.

For deactivation of the braking mode, the electromagnet 43 is deactivated and the control means 24—moved by the spring force of the spring element 44—is displaced to its blocking position. As a result of the pressure drop in the valve means 21 the latter is also displaced to its blocking position by the spring force of the spring element 45. In the blocking position of the valve means 21 a connection between the internal combustion engine oil circuit 35 and the pressure chambers 37, 38 is interrupted. In addition, the pressure chambers 37, 38 are connected via the valve means 21 to a tank 48, so that the internal combustion engine oil can flow out of the pressure chambers 37, 38. The slave piston 17 is displaced by the brake cam 23 to its end position oriented away from the brake cam 23, and the master piston 19 is displaced by the spring force of the return spring 40 to its end position oriented away from the rocker arm 10.

What is claimed is:

1. A gas exchange valve actuating device for_an internal combustion engine having a valve operating lever (10) for transmitting a drive movement from a camshaft (28) to at least one gas exchange valve (11, 12) and having an internal combustion engine braking unit (13) coupled to the valve operating lever (10) for directly mechanically transmitting thereto an activating force for opening the at least one gas exchange valve (11, 12) in a braking mode operation of the internal combustion engine the engine braking unit (13) including a hydraulic unit for transmitting the actuating force to the valve operating lever (10) of the at least one gas exchange valve (11, 12) and a one-piece housing unit (15) which has at least one first support structure (16) for a slave piston (17) and at least one second support structure (18) for a master piston (19) of the hydraulic unit.

2. The gas exchange valve actuating device as claimed in claim 1, wherein the valve operating lever (10) is a double lever for actuating at least two exchange valves (11, 12).

3. The gas exchange valve actuating device as claimed in claim 1, wherein the housing unit (15) includes at least one valve support structure (20) for supporting a valve means (21).

4. The gas exchange valve actuating device as claimed in claim 1, wherein the internal combustion engine braking unit (13) includes a hydraulic lift limiting unit (14) for limiting movement of the master piston (19) of the hydraulic unit.

5. The gas exchange valve actuating device as claimed in claim 1, wherein the internal combustion engine braking unit (13) includes a slave piston (17) with a cam follower (22) provided with a roll body (27).

6. The gas exchange valve actuating device as claimed in claim 1, wherein the internal combustion engine braking unit (13) is uncoupled from the valve operating lever (10) in at least one operating mode.

7. The gas exchange valve actuating device as claimed in claim 6, wherein the internal combustion engine braking unit (13) is uncoupled from a drive means in an engine power operating mode.

8. The gas exchange valve actuating device as claimed in claim 1, wherein the internal combustion engine braking unit (13) has a brake cam (23) with at least two cam structures.

9. The gas exchange valve actuating device as claimed in claim 1, wherein the internal combustion engine braking unit (13) has at least one control means (24) for controlling actuation of the gas exchange valves (11, 12) associated with at least two different internal combustion engine cylinders.

* * * * *